US010889409B2

(12) United States Patent
Akutsu et al.

(10) Patent No.: US 10,889,409 B2
(45) Date of Patent: Jan. 12, 2021

(54) PACKAGE CONTAINING FLUID CONTENT

(71) Applicants: TOYO SEIKAN GROUP HOLDINGS, LTD., Tokyo (JP); Toyo Seikan Co., Ltd., Tokyo (JP)

(72) Inventors: Yosuke Akutsu, Yokohama (JP); Kota Okamoto, Yokohama (JP); Shinya Seito, Yokohama (JP); Keisuke Nyuu, Yokohama (JP); Tomoyuki Miyazaki, Yokohama (JP)

(73) Assignees: TOYO SEIKAN GROUP HOLDINGS, LTD., Tokyo (JP); TOYO SEIKAN CO., LTD., Tokyo (JP)

( * ) Notice: Subject to any disclaimer, the term of this patent is extended or adjusted under 35 U.S.C. 154(b) by 416 days.

(21) Appl. No.: 15/755,647

(22) PCT Filed: Aug. 30, 2016

(86) PCT No.: PCT/JP2016/075260
§ 371 (c)(1),
(2) Date: Feb. 27, 2018

(87) PCT Pub. No.: WO2017/056820
PCT Pub. Date: Apr. 6, 2017

(65) Prior Publication Data

US 2020/0231334 A1 Jul. 23, 2020

(30) Foreign Application Priority Data

Sep. 30, 2015 (JP) ..... 2015-192961

(51) Int. Cl.
*B65D 1/02* (2006.01)
*B65D 23/02* (2006.01)
*B65D 85/72* (2006.01)

(52) U.S. Cl.
CPC ..... *B65D 23/02* (2013.01); *B65D 1/0207* (2013.01); *B65D 1/0215* (2013.01); *B65D 85/72* (2013.01)

(58) Field of Classification Search
CPC ..... B65D 23/02; B65D 1/0207; B65D 1/02; B65D 1/0215; B65D 1/40; B65D 85/80; B65D 85/72
(Continued)

(56) References Cited

U.S. PATENT DOCUMENTS 8,535,779 B1 9/2013 Smith et al.
8,940,361 B2 1/2015 Smith et al.
(Continued)

FOREIGN PATENT DOCUMENTS

JP 2010-254377 A 11/2010
JP 4878650 B1 2/2012
(Continued)

OTHER PUBLICATIONS

International Search Report for PCT/JP2016/075260, dated Nov. 29, 2016.

*Primary Examiner* — Robert J Hicks
(74) *Attorney, Agent, or Firm* — Sughrue Mion, PLLC

(57) ABSTRACT

A package including a container body (1) containing a fluid content (3) with leaving a head space (7), wherein the container body (1) has an inner surface (1*a*) on which ruggedness is formed entirely, the inner surface (1*a*) with the ruggedness of the container body (1) is coated with a lubricating liquid (30) immiscible with the fluid content (3), and the lubricating liquid (30) is present as a coating layer interposed between the inner surface (1*a*) and the fluid content (3), and the lubricating liquid (30) for forming the coating layer forms a liquid pool (31) at a periphery of an
(Continued)

(UPRIGHT STATE)

upper end face of the fluid content (3) contained in the container body (1) in a state of being held upright.

4 Claims, 2 Drawing Sheets

(58) Field of Classification Search
USPC ..... 215/12.2, 12.1; 206/524.3, 524.1; 220/62.22, 62.12, DIG. 11
See application file for complete search history.

(56) References Cited

U.S. PATENT DOCUMENTS

| | | | | |
|---|---|---|---|---|
| 9,327,879 | B2 | 5/2016 | Sekiguchi et al. | |
| 9,371,173 | B2 | 6/2016 | Smith et al. | |
| 2005/0260371 | A1* | 11/2005 | Shi | B29C 49/08 428/35.7 |
| 2008/0283483 | A1* | 11/2008 | Kim | B65D 23/02 215/12.2 |
| 2010/0086715 | A1* | 4/2010 | Katou | B32B 27/36 428/35.7 |
| 2015/0076030 | A1 | 3/2015 | Smith | |
| 2016/0039557 | A1 | 2/2016 | Akutsu et al. | |
| 2016/0152786 | A1 | 6/2016 | Akutsu et al. | |
| 2017/0101217 | A1 | 4/2017 | Akutsu et al. | |
| 2017/0130155 | A1 | 5/2017 | Okada et al. | |
| 2017/0144828 | A1 | 5/2017 | Smith et al. | |
| 2017/0190142 | A1 | 7/2017 | Okada et al. | |
| 2017/0321071 | A1 | 11/2017 | Okada et al. | |

FOREIGN PATENT DOCUMENTS

| | | | | |
|---|---|---|---|---|
| JP | 5673870 | B1 | 2/2015 | |
| JP | 2015-510857 | A | 4/2015 | |
| JP | 5713154 | B1 | 5/2015 | |
| JP | 2016-005966 | A | 1/2016 | |
| WO | WO-2013141888 | A1 * | 9/2013 | B65D 25/14 |
| WO | 2015/194251 | A1 | 12/2015 | |

* cited by examiner

PACKAGE CONTAINING FLUID CONTENT

This application is a National Stage of International Application No. PCT/JP2016/075260 filed Aug. 30, 2016, claiming priority based on Japanese Patent Application No. 2015-192961 filed Sep. 30, 2015.

TECHNICAL FIELD

The present invention relates to a package comprising a container body containing a fluid content. More specifically, the present invention relates to a package comprising a container body having an inner surface provided with ruggedness, and on the inner surface, a coating layer of a lubricating liquid for improving slipping property to the fluid content is formed.

BACKGROUND ART

Since plastic containers can be formed easily and produced at a low cost, they have been used widely in various fields. In particular, a bottle-shaped olefinic resin container that has a container wall with an inner surface formed of an olefinic resin such as a low-density polyethylene or the like and that is formed by direct blow forming is used preferably for a container to contain a viscous slurry or paste-like content such as ketchup, from the viewpoint of easy squeezing of the content.

A bottle containing a viscous content is often stored in an inverted state so that the content may be rapidly discharged or the content may be used up without remaining inside the bottle. For this reason, it is desirable for the bottle to allow the viscous content to rapidly fall off without adhering or remaining onto the inner wall surface of the bottle when the bottle is placed upside-down.

As a bottle to satisfy such requirements, for instance, Patent document 1 proposes a container including hydrophobic oxide fine particles adhering to the inner surface of the bottle, where the fine particles has a primary particle diameter in a range of 3 to 100 nm.

Patent document 2 proposes a lid having a water-repellent film formed on the surface thereof. The water-repellet film has a structure which includes a resin film formed of resin particles having an average particle diameter in a range of 1 μm to 20 μm, and oxide fine particles dispersed and adhered to the surface of the resin film, with the oxide fine particles having an average particle diameter in a range of 5 nm to 100 nm.

Each of the aforementioned techniques relates to formation of fine ruggedness on a surface to be brought into contact with the content in order to exhibit water-repellency (hydrophobicity) by a finely rugged surface. This effect is imparted not only by the hydrophobicity of the materials forming the rugged surface but an air layer formed in voids on the rugged surface. This air layer is more hydrophobic than the materials forming the container, thereby improving the non-adhesiveness to an aqueous content.

The thus finely rugged surface may have an enhanced non-adhesiveness to the aqueous content. However, in a case where the content and the finely rugged surface are in a constant contact with each other, condensation of moisture is very likely to occur at dents on the finely rugged surface. As a result, the dents are filled with water of condensation to cause deterioration in the slipping property. In other words, there has been demand for further improvement of the slipping property.

Patent document 3 proposes a container having an inner surface with ruggedness where a liquid is held stably by the ruggedness. The container utilizes a capillary phenomenon of the ruggedness to stably hold a layer of the liquid on the container inner surface. With this liquid layer, the slipping property to the content can be improved.

However, the technique of this document involves a problem in the process of forming ruggedness on the inner surface of the container. Since the ruggedness is to hold the liquid by a capillary phenomenon, the pitch is extremely small, and the ruggedness have a height considerably greater than the pitch, thereby to make the capillary force predominant and to prevent the liquid from falling due to the gravity. The ruggedness may be formed in a post-process after formation of the container body, for instance, by blowing a liquid in which fine particles for forming ruggedness is dispersed, or by etching. As a result, for a case of formation of a bottle or the like, processes for forming ruggedness after formation of the container will be extremely complicated to raise considerably the production cost and the like.

The present inventors have proposed in Patent document 4 a container to solve the aforementioned problems. The container also has ruggedness formed on the inner surface, and a liquid layer of a lubricating liquid is formed on the inner surface with ruggedness. This technique may be similar to the technique of the aforementioned Patent document 3 in utilizing the liquid layer for improving slipping property to a content in the container.

In the Patent document 4, the liquid layer has a partially protruding area on its surface. Specifically, the ruggedness of the container inner surface are reflected on the surface of the liquid layer, so that protrusions are formed in the surface of the liquid layer to correspond to the ruggedness on the inner surface of the container. This is one of the essential features of this technique. That is, the thus formed liquid layer is a thin layer that simply wets the inner surface of the container. When the content flows on the area where the liquid layer is formed, the content may flow while being in contact with the liquid layer (the locally protruding portion) and the air layer present among the locally protruded liquid layer. This may provide slipping property further preferable when compared with a case of simply allowing the content to flow while being in contact with the liquid layer in the container.

The technique according to Patent document 4 can improve remarkably slipping property to the content in the container. Moreover, the ruggedness on the inner surface of the container can be formed not by a post-process after formation of the container but by mixing fine particles used as a surface roughening agent with a resin for forming the inner surface of the container and forming them into the container. In other words, the ruggedness is not limited in particular as long as they can hold a liquid to wet the inner surface of the container. Since the ruggedness is not required to exhibit a capillary force to hold therein the liquid, the pitch may be greater than the height of the ruggedness, for instance. The ruggedness can be formed by mixing the resin to form the inner surface of the container with a certain amount of fine particles for surface roughening and subjecting the resulting mixture to forming. This process does not require any complicated post-process after formation of the container, and thus, it provides a remarkable advantage from the viewpoint of productivity, production cost and the like.

However, even the technique of Patent document 4 by the present inventors still involves problems to be solved.

Since the technique of Patent document 4 relates to an extremely thin liquid layer of the lubricating liquid on the inner surface of the container, the technique of spraying the lubricating liquid on the container inner surface is not suitable to form a liquid layer. Therefore, the liquid layer is formed by an internal addition process of forming the container by mixing a lubricating liquid with a resin to form the container inner surface. That is, the liquid layer is formed by bleeding of the lubricating liquid from the resin layer that constitutes the container inner surface.

The internal addition process is considered as advantageous for forming a thin liquid layer, but it has difficulty in forming a layer of a uniform thickness on the entire inner surface. As a result, the liquid layer may be missing at some parts of the inner surface. In some cases, the liquid layer may be extremely thick at some parts since the ruggedness on the inner surface have insufficient power to hold the liquid. This may easily result in variations in slipping property to the content, and thus, further improvement is needed.

It is possible to form the liquid layer by spraying the lubricating liquid on the container inner surface. In that case, however, the amount of liquid for forming the liquid layer may be excessive. As a result, after spraying, a step of inverting the container to discharge excessive lubricating liquid is required before filling the container with contents. In conclusion, spraying cannot be employed from the viewpoint of avoiding profligate use of the lubricating liquid, useless process steps, and the like.

PRIOR ART DOCUMENTS

Patent Documents

Patent Document 1: JP-A-2010-254377

Patent Document 2: Japanese Patent No. 4878650

Patent Document 3: Japanese Translation of PCT International Application Publication No. JP-T-2015-510857

Patent Document 4: Japanese Patent No. 5673870 Outline of the Invention:

Problems that the Invention is to Solve

Therefore, an object of the present invention is to provide a package comprising a container body containing a fluid content, the container body has ruggedness formed on its entire inner surface, and the inner surface with the ruggedness is coated with a lubricating liquid. In particular, the present invention aims to provide a package that can exhibit stable slipping property to a fluid content by the lubricating liquid, thereby enabling rapid discharge of the content. Furthermore, the package can be produced easily without increase in the production cost.

Means for Solving the Problems

After a number of experiments for the aforementioned package, the inventors have achieved the present invention through a finding that slipping property to a fluid content to be contained in a container body can be exhibited stably for a long period of time when small ruggedness having a modest capillary force are formed on the inner surface of the container body and these ruggedness is completely coated with an excessive amount of lubricating liquid.

That is, the present invention provides a package comprising a container body containing a fluid content with leaving a head space, wherein the container body has an inner surface on which ruggedness is formed entirely, the inner surface with the ruggedness of the container body is coated with a lubricating liquid immiscible with the fluid content, and the lubricating liquid is present as a coating layer interposed between the inner surface and the fluid content, and the lubricating liquid for forming the coating layer forms a liquid pool at a periphery of an upper end face of the fluid content contained in the container body in a state of being held upright.

It is preferable in the package of the present invention that:

(1) the ruggedness is formed as fine protrusions having a height of not less than 0.7 μm, and the fine protrusions have a pitch greater than the height;

(2) the inner surface of the container body is formed of a thermoplastic resin layer where fine particles having an average particle diameter of not more than 40 μm are dispersed as a surface roughening agent; and (3) the fluid content is a viscous substance having a viscosity of not less than 100 mPa·s at 25° C.

Effects of the Invention

The package of the present invention has a remarkable property in that a liquid pool of a lubricating liquid is formed at the periphery of the upper end face of the fluid content contained in the container body in an upright state. In other words, the liquid pool of the lubricating liquid is formed at the upper end periphery of the fluid content, and thus, at the time of tilting the container body to discharge the fluid content, the fluid content may be discharged keeping contact with the lubricating liquid. As a result, the package of the present invention can at all times exhibit slipping property imparted by the lubricating liquid.

In forming the aforementioned liquid pool of the lubricating liquid, the ruggedness formed on the inner surface of the container body are not required to have a shape for providing a predominant capillary force to the fluid content. The ruggedness can be formed by internally adding the lubricating liquid to a resin for forming the inner surface of the container body, and the post-process after formation of the container is not required.

The liquid pool of the lubricating liquid is formed by falling of the lubricating liquid that coats the ruggedness in the head space area, which indicates that the layer of the lubricating liquid that coats the ruggedness on the inner surface of the container body can be formed by spraying an excessive amount of lubricating liquid onto the inner surface of the container body. Namely, the coating layer of the lubricating liquid can be formed without employing an internal addition of the lubricating liquid to a resin, which may easily cause thickness variation or the like.

As a result, in the package of the present invention, the ruggedness on the inner surface of the container body can be formed without using any complicated and costly post-process. Furthermore, since coating with the lubricating liquid is conducted in a simple manner by spraying the lubricating liquid on the inner surface of the container body, variation in thickness of the coating layer of the lubricating liquid or the like can be avoided effectively.

As mentioned above, according to the present invention, it is possible to obtain a package that can exhibit stably the properties of the lubricating liquid, in a considerably simple manner without using any complicated and costly processes.

Further in the present invention, a liquid diffusion preventing layer to prevent or block diffusion of the liquid that forms the liquid layer is arranged beneath a surface resin layer of the resin formed article that supports the liquid layer. As a result, the liquid layer can be held stably for a long period of time, thereby exhibiting the surface modifying effect for a long period of time.

The package of the present invention can improve stably the slipping property to the fluid content by using any suitable lubricating liquid selected in accordance with the type of the fluid content to be contained in the container body. Therefore, it can be used especially preferably for containing a viscous liquid, for instance a viscous substance having a viscosity of not less than 100 mPa·s at 25° C. (e.g., ketchup and mayonnaise).

MODE FOR CARRYING OUT THE INVENTION

<Structure and Function of Package>

Figure 1A:
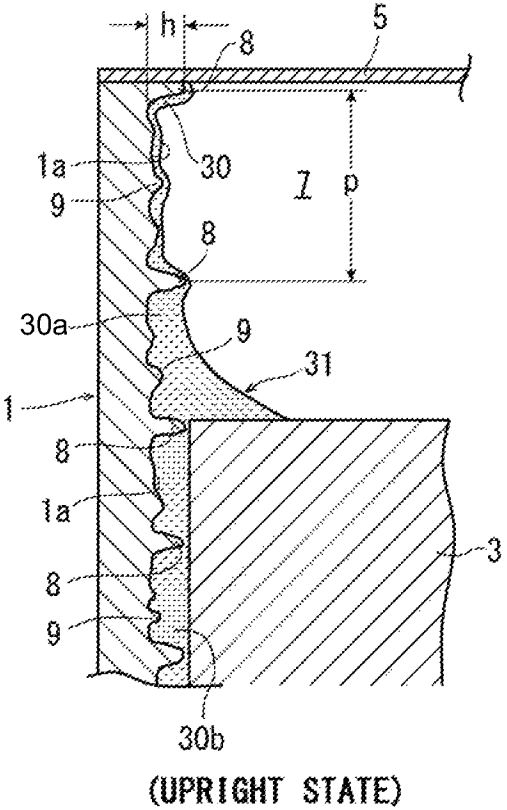
FIGS. 1A to 1C are a set of schematic cross-sectional views, one of which showing principal parts of a package of the present invention, and the others showing the parts in a state of discharging a fluid content.
Figure 1B:
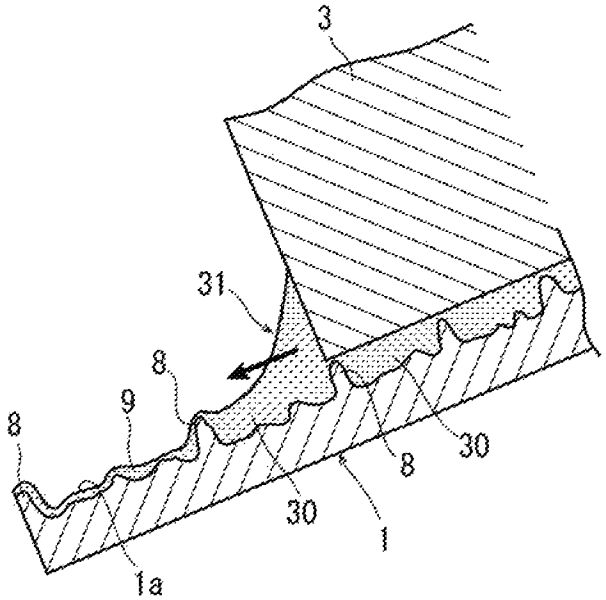
Figure 1C:
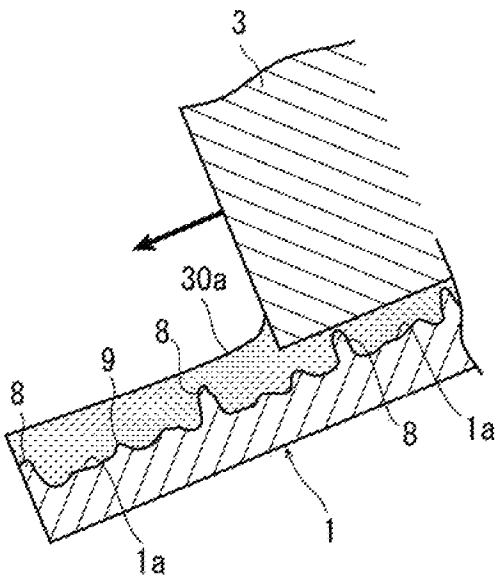

The package of the present invention as shown in FIGS. 1A to 1C comprises a container body 1 containing a fluid content 3. In particular, as shown in FIG. 1A, the container body 1 in an upright state is sealed at the upper end with a sealing foil 5, and appropriately closed with a lid (not shown). A head space 7 is formed between the upper end face of the fluid content 3 and the upper end of the container body 1 (sealing foil 5).

Figure 2:
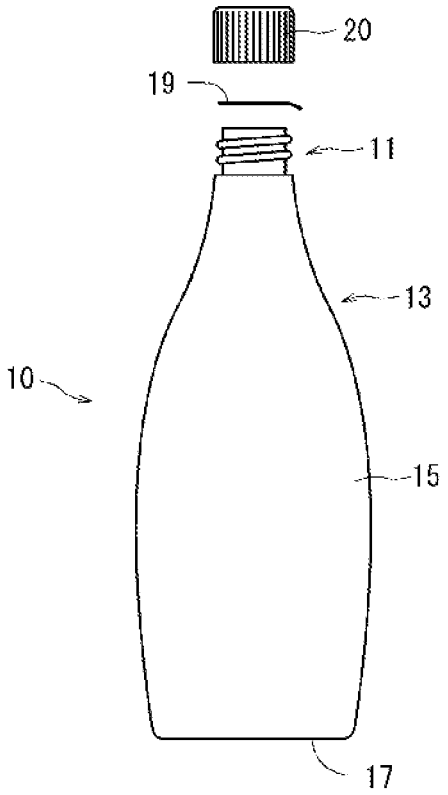
FIG. 2 is an overall view showing a directly blow-formed bottle as one the most preferable embodiment of a container body of the package of the present invention.

A preferable example of the container body 1 is a directly blow-formed bottle, which is shown in FIG. 2.

The directly blow-formed bottle (corresponding to the container body 1 in FIGS. 1A to 1C denoted as 10 as a whole in FIG. 2 has a screwed neck portion 11, a body portion wall 15 linked to the neck portion 11 through a shoulder portion 13, and a bottom wall 17 that closes the lower end of the body portion wall 15. An opening at the upper end thereof is closed with a sealing member 19 such as an aluminum foil (corresponding to the sealing foil 5 in FIGS. 1A to 1C) after filling with the aforementioned fluid content 3 (not shown in FIG. 2), and further screw-equipped with a cap 20 to ensure its sealing property.

The bottle 10 is used preferably for containing a viscous fluid content. The viscous substance contained in the bottle may be discharged by squeezing the bottle at the body portion wall 15.

The inner surface of the container body 1 (e.g., the directly blow-formed bottle 10 in FIG. 2) shown in FIGS. 1A to 1C are rugged surface 1*a* formed of fine protrusions 8 that are distributed entirely and that have a height h of not less than 0.7 μm. The rugged surface 1*a* is coated with a lubricating liquid 30 to improve slipping property to the fluid content 3. The lubricating liquid 30 is interposed between the fluid content 3 and the inner surface (rugged surface 1*a*) of the container body 1, and no air layer is present therebetween.

On the rugged surface 1*a*, small protrusions 9 having height lower than the fine protrusions 8 are distributed. The small protrusions 9 do not impose influences on the slipping property or the like, and they may be ignorable in the present invention.

As shown in FIG. 1A, the package of the present invention having the basic structure as mentioned above has a liquid pool 31 of the lubricating liquid 30 formed at the periphery of the upper end face of the fluid content 3 in the container body 1 in an upright state. Namely in the upright state, the lubricating liquid 30 coating the rugged surface 1*a* in the head space 7 located above the fluid content 3 flows down to form the liquid pool 31 of the lubricating liquid 30. As a result, the lubricating liquid 30 does not enter the voids among the fine protrusions 8 at the upper area of the rugged surface 1*a* in the the head space 7.

In the present invention, the liquid pool 31 formed in this manner may serve to exhibit excellent slipping property stably at the time of discharging the fluid content 3.

For instance, for discharging this fluid content 3, the sealing foil 5 is peeled off and then the container body 1 is tilted as shown in FIG. 1B, whereby the lubricating liquid 30 forming the liquid pool 31 flows on the rugged surface 1*a* to reach the upper end of the container body 1. The fluid content 3 is discharged in this state. At this time, as shown in FIG. 1(C) FIG. 1C, the lubricating liquid 30 of the liquid pool 31 flows down to form a thick film 30*a* that completely covers the fine protrusions 8 and also completely fills the voids among the fine protrusions 8 on the rugged surface 1*a* located to correspond to the head space 7. The fluid content 3 being in contact with the thick film 30*a* of the lubricating liquid 30 may be discharged with a part of the lubricating liquid 30 or it may slide on the thick film 30*a* of the lubricating liquid 30, whereby a stable and excellent slipping property may be exhibited.

At this time, the thick film 30*a* of the lubricating liquid 30 is formed on the rugged surface 1*a*. When this thick film 30*a* flows on the rugged surface 1*a*, a flow resistance is generated due to the fine protrusions 8 constituting the rugged surface 1*a*. Due to the flow resistance, the thick film 30*a* itself flows more slowly in comparison with a case where the lubricating liquid flows on a flat and smooth surface. This indicates that formation of a film of the lubricating liquid on the rugged surface 1*a* can reduce the amount of the lubricating liquid 30 to be discharged together with the fluid content 3, in comparison with the case of coating a flat and smooth surface with the film of the lubricating liquid. That is, the effect of preventing reduction of the amount of the lubricating liquid 30 may be one of the important advantages of the present invention.

When the container body 1 is tilted, the fluid content 3 may be peeled off from the rugged surface (not shown) facing the thick lubricating liquid film 30*a* side as shown in FIG. 1C, i.e., the rugged surface to face upward at the time of tilting (namely, the rugged surface facing downward). At this time, the liquid pool 31 serves as the starting point for the peeling to proceed the peeling from the side wall toward the bottom portion. The liquid pool 31 serves as the starting point of peeling in this manner, and it provides another advantage of improving slipping property to the content.

After tilting the container body 1 and discharging a part of the fluid content 3 as mentioned above, the container body 1 is held upright, equipped with a lid appropriately to be sealed. In the upright state, the excessive lubricating liquid 30 that coats the rugged surface 1*a* at the position corresponding to the head space 7 may flow down, and thus, the liquid pool 31 of the lubricating liquid 30 may be formed again at the periphery of the upper end face of the fluid content 3 as shown in FIG. 1A. Therefore, when the container body 1 is tilted again to discharge the fluid content 3, the thick film 30*a* of the lubricating liquid 30 similarly may be formed in the head space, thereby exhibiting excellent slipping property.

In the package of the present invention, the rugged surface 1*a* may be formed of the aforementioned fine protrusions 8. Preferably, the fine protrusions 8 have a pitch p greater than the height h of the fine protrusions 8. It is particularly preferable that the fine protrusions 8 are formed at a pitch of 20 to 500 μm in average, and more preferably at a pitch of 30 to 400 μm. This condition is established so that the capillary force provided by the fine protrusions 8 to the lubricating liquid may not be predominant to the gravity, whereby the lubricating liquid 30 that coats the rugged surface 1*a* may flow down rapidly without being held by the capillary force.

For instance, if the lubricating liquid 30 was held on the rugged surface 1*a* by the capillary force, formation of the liquid pool 31 of an amount capable of improving the slipping property would be difficult, since the amount of lubricating liquid 30 to flow down from the rugged surface 1*a* in the head space 7 would be decreased.

It is preferable that the fine protrusions 8 are distributed on the inner surface of the container body 1 at a density of 10 to 2500 number/mm$^2$, and further preferably 20 to 1500 number/mm$^2$. If the fine protrusions 8 were not formed at a proper density, resistance against the flow of the lubricating liquid 30 would be decreased. As a result, at the time of tilting the container body 1 to discharge the fluid content 3, a large amount of lubricating liquid 30 would be discharged with the fluid content 3 to lose the effect of improving the slipping property provided by the lubricating liquid 30 in a short period of time. In particular, in a case where the rugged surface 1*a* was not formed on the inner surface of the container body 1, the lubricating liquid 30 would be discharged immediately as mentioned above, and thus, the effect of improving the slipping property would not be exhibited substantially.

As explained in Examples below, such as the presence of the fine protrusions 8 that constitute the aforementioned rugged surface 1*a* can be analyzed with an atomic force microscope, a laser microscope, a white-light interference microscope and the like. Moreover, the presence of the liquid pool 31 can be confirmed easily by visual observation or collection by use of glass capillary tube or the like.

In the present invention, the rugged surface 1*a* with the aforementioned fine protrusions 8 is not formed by a post-process after forming the container body 1, but it can be formed by internally adding a surface roughening agent to the resin for forming the inner surface of the container body 1. This is one of the remarkable advantage of the present invention. In formation of the rugged surface 1*a* by the internal addition of the surface roughening agent, usually, the upper limit in height of the fine protrusions 8 is about 50 to about 100 μm. When fine particles having an average particle diameter of not more than 40 μm are used as the surface roughening agent to be dispersed in a thermoplastic resin layer, the upper limit of the height is about 30 μm. For fine particles having an average particle diameter of about 20 μm, the upper limit for height is about 15 μm.

Further, it can be understood from the above description that the amount of the lubricating liquid 30 coating the rugged surface 1*a* is excessively applied to completely cover the fine protrusions 8 constituting this rugged surface 1*a* and to fill the voids among the protrusions 8. Specifically, it is possible to spray the lubricating liquid 30 onto the rugged surface 1*a* of the inner surface of the container body 1. This is another remarkable advantage of the present invention.

<Container Body 1>

In the present invention, the container body 1 has an inner surface that is the rugged surface 1*a* formed of the fine protrusions 8.

The materials to form the inner surface of the container body 1 are not limited in particular, and they can be selected from thermoplastic resins, thermosetting resins, glass and metals depending on the use and the contents. Among them, the thermoplastic resins are not limited in particular as long as they can be formed into container shapes. Usually, it is preferably selected from olefin resins such as low-density polyethylene, linear low-density polyethylene, medium- or high-density polyethylene, polypropylene, poly(l-butene), and poly(4-methyl-1-pentene), copolymer resins of these olefins, and polyester resins such as polyethylene terephthalate, polyethylene naphthalate, and polyethylene terephthalate/isophthalate. These are preferably used also for forming an outer surface of the container.

In a case of using this container body 1 as a directly blow-formed bottle as shown in FIG. 2, olefin resins as represented by the low-density polyethylene and the linear low-density polyethylene are used preferably since they are suitable for squeezing out the contents.

A surface roughening agent is mixed with the thermoplastic resin for forming the inner surface in order to form the rugged surface 1*a* with the fine protrusions 8. For the surface roughening agent, fine particles having an average particle diameter of not more than 40 μm, in particular in a range of 0.2 to 20 μm, may be used. When the thermoplastic resin mixed with the fine particles is subjected for forming, sets of continuous fine particles are raised to form the aforementioned fine protrusions 8. Furthermore, the fine particles are coated with the thermoplastic resin to constitute the inner surface of the container body 1, and thereby firmly fixed on the inner surface. Therefore, the lubricating liquid 30 in contact with the rugged surface 1*a* formed of the fine protrusions 8 can be stably held.

In particular, in the present invention, the rugged surface 1*a* formed of the fine protrusions 8 can be formed by internally adding the surface roughening agent to the resin. This serves to avoid dropping of the fine protrusions 8 or the like more effectively in comparison with a case of forming the rugged surface 1*a* by spraying the particles for surface roughening. This is one of the remarkable effects of the present invention.

The average particle diameter of the fine particles can be measured by laser diffraction and scattering method using a laser diffraction particle size analyzer and the like, and it can be calculated as a volume-based integrated particle diameter of 50% in the measured particle size distribution. For fine particles of silica or the like having a primary particle diameter of not more than 0.2 μm, it is extremely difficult to maintain the particles singly as primary particles, and thus, the particle diameter of secondary particles is calculated as the average particle diameter.

The fine particles used as the aforementioned surface roughening agent are not limited in particular as long as their average particle diameter is within the aforementioned range. Representative examples thereof include: particles of metal oxides such as titanium oxide, alumina, and silica; fine particles based on carbon such as carbonates like calcium carbonate, and carbon black; and organic fine particles formed of poly(methyl (meth)acrylate) cured products, ultra high molecular weight polyethylene, and silicone particles as represented by polyorganosilsesquioxane. They may or may not be subjected to hydrophobic treatment with a silane coupling agent, a silicone oil or the like. In the present invention, the process can be performed also by extrusion such as direct blow forming as long as the particle diameter can be kept after melt forming. Examples of materials preferably used for this purpose include fine particles subjected to hydrophobic treatment, particularly hydrophobic silica, cured poly(methyl methacrylate), ultra high molecular weight polyethylene, polyorganosilsesquioxane, and silicone particles.

The fine particles is used as the surface roughening agent usually in an amount of 0.1 to 30 parts by mass, preferably 0.3 to 20 parts by mass, and further preferably 0.3 to 10 parts by mass relative to 100 parts by mass of resin that forms the inner surface of the container body 1 in order to form the fine protrusions 8 of height h, pitch p and density as mentioned above.

Further in the present invention, the container body 1 may have single layer structure or a multi-layered structure of a resin mixed with the aforementioned surface roughening agent as long as the inner surface is the rugged surface 1*a* formed of the fine protrusions 8.

For instance, a gas barrier resin layer can be formed as an intermediate layer between the inner surface layer (the aforementioned resin layer containing a surface roughening agent) and the outer surface layer (a resin layer not mixed with a surface roughening agent), thereby preventing the content 3 from deteriorating caused by permeation of a gas such as oxygen.

Examples of the above-mentioned gas barrier resin include ethylene-vinyl alcohol copolymer (saponified ethylene-vinyl acetate copolymer), aromatic polyamide and cyclic polyolefin. Among them, the ethylene-vinyl alcohol copolymer is the most preferred since it exhibits particularly excellent oxygen barrier property.

As the above-mentioned ethylene-vinyl alcohol copolymer, a saponified copolymer obtained by saponifying an ethylene-vinyl acetate copolymer having an ethylene content of 20 to 60 mol %, particularly 25 to 50 mol % so that the saponification degree reaches 96 mol % or more and particularly 99 mol % or more.

The aforementioned gas barrier resins each can be used by it self or in blends of two or more different types thereof. For improving adhesion to the inner surface layer or the outer surface layer, polyolefins such as polyethylene may be blended in the gas barrier resin in a range not degrading the gas barrier property.

In a case of providing the gas barrier layer as the intermediate layer, it is preferable to provide an adhesive resin layer between the inner surface layer and the gas barrier layer and between the outer surface layer and the gas barrier layer in order to improve the adhesion between the inner surface layer on which a predetermined rugged surface 1*a* is formed or the outer surface layer, thereby preventing delamination.

Adhesive resins used for forming the adhesive layer are known per se, and for instance, they are resins containing a carbonyl group (>C=O) in the main chain or the side chain, in an amount of 1 to 100 meq/100 g resin, in particular, 10 to 100 meq/100 g resin. Specific examples of such resins to be used as adhesive resins include: an olefin resin graft-modified with a carboxylic acid such as maleic acid, itaconic acid or fumaric acid or an anhydride thereof, or with an amide or an ester; an ethylene-acrylic acid copolymer; an ionically crosslinked olefin copolymer; and an ethylene-vinyl acetate copolymer.

Furthermore, the multi-layered structure may have a reproduced layer obtained from a virgin resin which is used for forming the inner layer or the outer layer and which is mixed with a scrap resin such as burrs generated during formation of this container body 1.

The respective layers are set to have thickness known per se so that the properties required for the layers are to be exhibited. Moreover, additives such as an antioxidant, a surfactant and a colorant can be added to the resins for forming the respective layers as appropriate without impairing the properties of the respective layers.

The container body 1 has an inner surface provided with a predetermined rugged surface 1*a*. The shape is not limited in particular as long as the liquid pool 31 can be formed when the rugged surface 1*a* is coated with the lubricating liquid 30, and the container body 1 may a shape of a bottle or a cup.

The container body 1 may be produced by forming a preform through extrusion-forming of a resin for forming the aforementioned respective layers and then forming the preform into the predetermined container shape by post-processes such as blow-forming, a plug-assisted forming, and vacuum forming.

Particularly in the present invention, it is the most preferable that this container body 1 has a shape of a directly blow-formed bottle suitable for discharging the viscous fluid content as shown in FIG. 2. The directly blow-formed bottle may be produced by forming a tube-like preform by extrusion-forming, pinching off to close the preform at one end, and blowing a fluid such as air into this preform to shape it as a bottle.

<Lubricating Liquid 30 and Fluid Content 3>

In the packaging container of the present invention, the thus obtained rugged surface 1*a* as the inner surface of the container body 1 is coated with the lubricating liquid 30, and then the container body 1 is filled with the fluid content 3 so as to form the head space 7.

The lubricating liquid 30 having a suitable surface property is selected corresponding to the type of the fluid content 3 to be contained in the container body 1. Therefore, the lubricating liquid 30 is required to be immiscible with the fluid content 3. Here, a liquid being immiscible with the fluid content 3 means that the liquid may not molecularly dispersed instantly even when getting into contact with the fluid content 3 but remains as the lubricating liquid 30. Further, it is required to be a non-volatile liquid having a small vapor pressure under an atmospheric pressure, for instance, a liquid having a high boiling point of not lower than 200° C. If a volatile liquid was used, the liquid would easily be evaporated and lost over time, and thereby making it difficult to improve the slipping property to the fluid content 3.

Various examples can be listed as specific examples of the lubricating liquid 30 as long as they are the aforementioned liquids having high boiling point. In particular, a liquid having a surface tension considerably different from that of the fluid content 3 which slips over the liquid is preferred in the present invention, since the lubricating effect may be greater.

For instance, when the fluid content 3 is water or a hydrophilic substance containing water, a liquid having a surface tension in a range of 10 to 40 mN/m, in particular in a range of 16 to 35 mN/m is preferably used as the lubricating liquid 30. Representative examples thereof include fluorine-based liquids, fluorosurfactants, silicone oil, fatty acid triglyceride, and various vegetable oils. Preferable examples of the vegetable oils include soybean oil, rapeseed oil, olive oil, rice oil, corn oil, safflower oil, sesame oil, palm oil, castor oil, avocado oil, coconut oil, almond oil, walnut oil, hazel oil, and salad oil. These liquids may be blended in use.

In the present invention, the lubricating liquid 30 is used to coat the rugged surface 1*a* on the inner surface of the container body 1. Specifically, the coating process is conducted by applying an excessive amount of lubricating liquid 30 to the inner surface (rugged surface 1*a*) of the container body 1 such that the liquid pool 31 may be formed at the periphery of the fluid content 3 facing the head space 7 at the time of filling the container body with the fluid content 3 (see FIG. 1A).

That is, it is necessary to coat the entire rugged surface 1*a* with the excessive lubricating liquid 30 so that the lubricating liquid 30 may flow down from the rugged surface 1*a* located at a part facing the head space 7 when the container body 1 filled with the fluid content 3 is held upright as shown in FIG. 1A.

For this purpose, it is necessary to apply the lubricating liquid 30 to the entire inner surface of the container body 1 by spraying. For instance, it is preferable that the average coating amount is not less than 2.5 $g/m^2$, and in particular from about 10 to about 40 $g/m^2$. With this coating amount, the fine protrusions 8 that constitute the rugged surface 1*a* may be completely covered with the lubricating liquid 30, and the voids among the fine protrusions 8 may be completely filled with the lubricating liquid 30. In contrast, it would be impossible to form the liquid pool 31 by coating the rugged surface 1*a* with the excessive lubricating liquid 30 if the lubricating liquid 30 was mixed with a resin for forming the inner surface of the container body 1 in advance.

The lubricating liquid 30 may be sprayed on the container body 1 being held in an upright state or in an inverted state as long as the rugged surface 1*a* (inner surface) can be entirely coated with the excessive amount of lubricating liquid 30.

After applying the lubricating liquid 30 in the aforementioned manner, the container body 1 which is held in an upright state and which has the inner surface entirely coated with the excessive amount of the lubricating liquid 30 is filled with the fluid content 3 through a predetermined filling pipe such that the head space 7 is formed.

That is, in the present invention, the fine protrusions 8 constituting the rugged surface 1*a* have a height and a density such that its capillary force to the lubricating liquid 30 is not superior to the gravity. Therefore, at the time of filling the container body with the fluid content 3 as mentioned above, the lubricating liquid 30 covering the rugged surface 1*a* at the part corresponding to the head space 7 may flow down to form the liquid pool 31 at the periphery of the upper end face of the fluid content 3. As a result, a liquid film of the lubricating liquid 30 above the liquid pool 31 becomes thinner than a liquid film 30*b* of the lubricating liquid at a position between the side face of the fluid content 3 and the rugged surface 1*a* as shown in FIG. 1A.

The fluid content 3 used for the filling has a surface tension considerably different from that of the lubricating liquid 30 as mentioned above. Specifically, the fluid content 3 may be a viscous fluid having a viscosity of not less than 100 mPa·s at 25° C. Specific examples thereof include ketchup, aqueous paste, honey, various sauces, mayonnaise, mustard, dressing, jam, chocolate syrup, cosmetic liquids such as milky lotion, liquid detergent, shampoo, and rinse. That is, a suitable lubricating liquid 30 is used corresponding to the type of the fluid content 3 to form the liquid pool 31, so that the viscous fluid content 3 can be rapidly discharged by tilting or inverting the container.

For instance, ketchup, various sauces, honey, mayonnaise, mustard, mustard, jam, chocolate syrup, milky lotion and the like are hydrophilic substances containing water. For the lubricating liquid 30, oily liquids that have been approved as food additives, such as silicone oil, glycerin fatty acid ester, and edible oil, can be preferably used.

After filling the container with the fluid content 3 such that the head space 7 is formed and also forming the liquid pool 31 of the lubricating liquid 30 as mentioned above, the sealing foil 5 is attached by heat sealing and the lid is suitably attached to provide the package of the present invention.

EXAMPLES

The present invention will be described below by referring to Examples.

The method of measurements conducted in Examples below for measuring respective characteristics and physical properties, and the container bodies (bottles) are as mentioned below.

<Container Body>

A multi-layered directly blow-formed bottle having the following layer constitution and capacity of 200 mL was formed by a known method and used in experiments below.

Bottle A: directly blow-formed multi-layered bottle having 9 layers of 5 types

Layer constitution: inner layer/adhesive layer/liquid diffusion prevention layer/adhesive layer/main layer/adhesive layer/oxygen barrier layer/adhesive layer/outer layer Inner layer: low-density polyethylene containing 5 wt % silica (average particle diameter of silica=5 μm)

Adhesive layer: acid-modified polyethylene

Liquid diffusion prevention layer: ethylene-vinyl alcohol copolymer (EVOH)

Main layer: low-density polyethylene (LDPE)

Oxygen barrier layer: ethylene-vinyl alcohol copolymer (EVOH)

Outer layer: low-density polyethylene (LDPE)

Bottle B: directly blow-formed multi-layered bottle having 9 layers of 5 types

Layer constitution: inner layer/adhesive layer/liquid diffusion prevention layer/adhesive layer/main layer/adhesive layer/oxygen barrier layer/adhesive layer/outer layer Inner layer: low-density polyethylene (LDPE)

Adhesive layer: acid-modified polyethylene

Liquid diffusion prevention layer: ethylene-vinyl alcohol copolymer (EVOH)

Main layer: low-density polyethylene (LDPE)

Oxygen barrier layer: ethylene-vinyl alcohol copolymer (EVOH)

Outer layer: low-density polyethylene (LDPE)

<Lubricating Liquid>

Medium chain fatty acid triglyceride (MCT)

Surface tension: 28.8 mN/m (23° C.)

Viscosity: 33.8 mPa·s (23° C.)

Boiling point: 210° C. or higher

Flash point: 242° C. (reference value)

The surface tension of the liquid was measured at 23° C. using a solid-liquid interface analysis system DropMaster 700 (manufactured by Kyowa Interface Science Co., Ltd.). The density of the liquid required for the surface tension measurement was measured at 23° C. using a density/specific gravity meter DA-130 (manufactured by Kyoto Electronics Manufacturing Co., Ltd.). Further, the viscosity of the liquid was measured at 23° C. using a tuning-fork vibration viscometer SV-10 (manufactured by A&D Company Limited).

<Measurement of Surface Shape of Bottle Inner Surface>

A specimen of 20 mm×20 mm was cut out from the body portion of each of the multi-layered directly blow-formed bottles (bottle A and bottle B), and the shape of the bottle inner surface was measured using a non-contact surface profiler (NewView 7300, manufactured by Zygo Corporation).

For the measurement and the image analysis, MetroPro (Ver. 9.1.4 64-bit) was used as an application.

Measurement was conducted in a range of 0.699 mm×0.524 mm. From the thus obtained data, protrusion density (per surface area of 1 $mm^2$), average protrusion interval (pitch), the maximum protrusion height and an average protrusion height for the protrusions having a height of not less than 0.7 μm were calculated. The results of the measurement on the surface shape of the bottle inner surface were shown in Table 1 below.

<Fluid Content>

Mayonnaise-Type Viscous Food

Viscosity: 499 Pa·s (0.1 $sec^{-1}$)

94 Pa·s (1 $sec^{-1}$)

0.30 Pa·s (1000 $sec^{-1}$)

For the viscosity measurement, a rheometer (ARES manufactured by TA Instruments) was used. The values measured by the steady flow method at the geometry of the parallel plate with a gap 0.5 mm were indicated.

<Confirmation of Liquid Pool of Lubricating Liquid>

The bottle was filled with 200 g of a fluid content. After discharging 100 g of the content, the bottle was stored in an upright state for 1 day or longer, and the appearance was visually evaluated during the storage in the upright state.

Here, if a liquid pool of the lubricating liquid is visually observed at the periphery of the upper end face of the fluid content contained in the bottle body, it is expressed as 'Yes', and if such a liquid pool is not visually observable, it is expressed as 'No'.

time required for the content to completely slide toward the mouth portion of the bottle after the inversion. The criteria for evaluation are as follows.

◎: time for sliding down completely is less than 2 minutes

○: time for sliding down completely is 2 minutes or more and less than 5 minutes Δ: time for sliding down completely is 5 minutes or more and less than 10 minutes X: time for sliding down completely is 10 minutes or more Experimental Examples 1 to 3

The bottle A (directly blow-formed multi-layered bottle having 9 layers of 5 types) was prepared as the container body.

To the inner surface of the bottle A, medium chain fatty acid triglyceride as a lubricating liquid of the amount shown in Table 1 was applied by an air-spray method using an air brush. The bottle having the inner surface coated with the lubricating liquid was used to check the liquid pool of the aforementioned lubricating liquid and to conduct the test of slipping property to the fluid content. The results were shown in Table 1.

Experimental Examples 4 to 6

The bottle B (directly blow-formed multi-layered bottle having 9 layers of 5 types) was prepared as the container body. Medium chain fatty acid triglyceride of the amount shown in Table 1 was applied by the same method as in Example 1, which was followed by checking a liquid pool of the lubricating liquid and conducting the test of slipping property to the fluid content. The results were shown in Table 1.

TABLE 1

| | | Surface shape of bottle inner surface | | | | Coating | | Test of |
|---|---|---|---|---|---|---|---|---|
| | Packaging container | Protrusion density 1/$mm^2$ | Average protrusion pitch μm | Maximum protrusion height μm | Average protrusion height μm | amount of lubricating liquid g/$m^2$ | Liquid pool | slipping property to fluid content |
| Exptl. Ex. 1 | Bottle A | 1038 | 31 | 8.28 | 1.22 | 17.2 | Yes | ◎ |
| Exptl. Ex. 2 | ↑ | ↑ | ↑ | ↑ | ↑ | 4.7 | Yes | ○ |
| Exptl. Ex. 3 | ↑ | ↑ | ↑ | ↑ | ↑ | 2.2 | No | X |
| Exptl. Ex. 4 | Bottle B | 0 | — | — | — | 16.3 | Yes | ○ |
| Exptl. Ex. 5 | ↑ | ↑ | ↑ | ↑ | ↑ | 4.0 | Yes | X |
| Exptl. Ex. 6 | ↑ | ↑ | ↑ | ↑ | ↑ | 2.0 | No | X |

Exptl. Ex.: Experimental example

<Test of Slipping Property to Fluid Content>

After checking the liquid pool of the lubricating liquid, slipping property to the content was evaluated by using the bottle with 100 g of the fluid content remaining inside the bottle. Specifically, 50 g of the fluid content was squeezed out from the bottle in upright state at room temperature (25° C.), then the bottle was allowed to suck air to restore the bottle shape, and inverted at room temperature (25° C.) so as to evaluate the slipping property to the content based on the Table 1 shows that in Experimental examples 1 to 3, ruggedness were formed on the inner surfaces of the bottles and the inner surfaces with the ruggedness were coated with the lubricating liquid. In Experimental examples 1 and 2, formation of liquid pools of the lubricating liquid was observed. In these Experimental examples 1 and 2, the slipping property to the contents was favorable. In Experimental example 3, formation of liquid pool was not observed, and slipping property to the contents was not favorable.

Experimental examples 4 to 6 relate to the bottle B having an inner surface with no ruggedness and being coated with a lubricating liquid. The slipping property was reasonably favorable in Experimental example 4 where a liquid pool of the lubricating liquid was observed. In Experimental example 5, the slipping property was poor despite a liquid pool was observed.

In Experimental example 6 where formation of liquid pool was not observed, the slipping property was poor similarly to Experimental example 3.

In Experimental examples 1 and 4, and in Experimental examples 2 and 5, the same amounts of lubricating liquids were applied to the bottle inner surfaces. The bottles having inner surfaces with ruggedness provided favorable slipping property. The reason is considered as follows. That is, when the bottle is inverted or tilted, the liquid pool of the lubricating liquid formed on the periphery of the upper end face of the content forms a thick liquid film of the lubricating liquid in the direction in which the contents are headed, thereby exhibiting excellent slipping property.

DESCRIPTION OF REFERENCE NUMERALS

1: container body
1*a*: rugged surface (inner surface of container body 1)
3: fluid content
5: sealing foil
7: head space
8: fine protrusions
9: small protrusions 9 having height lower than fine protrusions 8
30: lubricating liquid
31: liquid pool

The invention claimed is:

1. A package including a container body containing a fluid content leaving a head space, wherein the container body has an inner surface on which ruggedness is formed entirely, the inner surface with the ruggedness of the container body is coated with a lubricating liquid immiscible with the fluid content, and the lubricating liquid is present as a coating layer interposed between the inner surface and the fluid content, the lubricating liquid for forming the coating layer forms a liquid pool at a periphery of an upper end face of the fluid content contained in the container body in a state of being held upright, and wherein in an upright state, an excess amount of the lubricating liquid flows down from the head space onto the periphery of the upper end face of the content so as to form a liquid pool with a bottom face on the upper end face of the content.

2. The package according to claim 1, wherein the ruggedness is formed as fine protrusions having a height of not less than 0.7 μm, and the fine protrusions have a pitch greater than the height.

3. The package according to claim 1, wherein the inner surface of the container body is formed of a thermoplastic resin layer where fine particles having an average particle diameter of not more than 40 μm are dispersed as a surface roughening agent.

4. The package according to claim 1, wherein the fluid content is a viscous substance having a viscosity of not less than 100 mPa·s at 25° C.

* * * * *